US011462155B1

(12) United States Patent
Vigier

(10) Patent No.: US 11,462,155 B1
(45) Date of Patent: Oct. 4, 2022

(54) EMISSIVE LED DISPLAY DEVICE

(71) Applicant: Commissariat à l'Energie Atomique et aux Energies Alternatives, Paris (FR)

(72) Inventor: Margaux Vigier, Grenoble (FR)

(73) Assignee: Commissariat à l'Energie Atomique et aux Energies Alternatives, Paris (FR)

( * ) Notice: Subject to any disclaimer, the term of this patent is extended or adjusted under 35 U.S.C. 154(b) by 0 days.

(21) Appl. No.: 17/654,362

(22) Filed: Mar. 10, 2022

(30) Foreign Application Priority Data

Mar. 18, 2021 (FR) ..... 2102701

(51) Int. Cl.
*G09G 3/32* (2016.01)
*G09G 3/00* (2006.01)

(52) U.S. Cl.
CPC ..... *G09G 3/32* (2013.01); *G09G 3/001* (2013.01); *G09G 2300/0861* (2013.01); *G09G 2310/0286* (2013.01); *G09G 2310/08* (2013.01); *G09G 2320/0233* (2013.01); *G09G 2320/0626* (2013.01)

(58) Field of Classification Search
CPC ..... G09G 3/32; G09G 3/3233; G09G 3/3225; G09G 3/3291; G09G 3/3648; G09G 2300/0426; G09G 2300/0842; G09G 2300/0809; G09G 2300/0452; G09G 2300/0408; G09G 2300/0439; G09G 2300/0861; G09G 2300/023; G09G 2310/0286; G09G 2310/08; G09G 2310/0264; G09G 2310/0278
See application file for complete search history.

(56) References Cited

U.S. PATENT DOCUMENTS

| | | | | |
|---|---|---|---|---|
| 6,317,138 | B1 | 11/2001 | Yano et al. | |
| 9,468,050 | B1 * | 10/2016 | Rotzoll | G09G 3/3233 |
| 2015/0339998 | A1 | 11/2015 | Yen et al. | |
| 2017/0270852 | A1 * | 9/2017 | Meitl | G09G 3/32 |
| 2018/0247586 | A1 * | 8/2018 | Vahid Far | G09G 3/3216 |
| 2021/0166618 | A1 * | 6/2021 | Baumheinrich | G09G 3/2081 |

OTHER PUBLICATIONS

Preliminary Search Report for French Application No. 2102701 dated Sep. 30, 2021, 2 pages.

* cited by examiner

*Primary Examiner* — Dong Hui Liang
(74) *Attorney, Agent, or Firm* — Moreno IP Law LLC

(57) ABSTRACT

The present description concerns an elementary module (100) of a display device enabling to display at least one pixel of an image, the module comprising: a first assembly of N LEDs (101(*i,j*)) distributed into M groups (G(i)), at least one of the M groups comprising at least two LEDs, where N and M are integers, with M greater than or equal to 2; and a control circuit comprising M bias circuits (103(*i*)) respectively associated with the M groups of LEDs, each bias circuit (103(*i*)) being shared by the LEDs of the corresponding group (G(i)) and being adapted to successively controlling the emission of the LEDs of the group.

13 Claims, 4 Drawing Sheets

EMISSIVE LED DISPLAY DEVICE

FIELD

The present disclosure concerns the forming of an emissive image display device comprising light-emitting diodes (LEDs), for example, a screen for a television, a computer, a smart phone, a tablet, etc. It more particularly concerns the forming of an elementary module of such a device.

BACKGROUND

There has already been provided, for example, in patent application WO2017089676 or in patent applications WO2018185433 and WO2018185434, an image display device comprising a plurality of elementary electronic chips, which will be called elementary modules hereafter, arranged in an array on a same transfer substrate. The modules are fixedly assembled to the transfer substrate and connected to electric connection elements of the transfer substrate for their control. Each module comprises one or a plurality of LEDs and a circuit for controlling said one or a plurality of LEDs and corresponds to a pixel of the device. More particularly, each module comprises a first chip called LED chip integrating said one or a plurality of LEDs of the module, and a second chip called control chip comprising the circuit for controlling said one or a plurality of LEDs of the module. The LED chip and the control chip are placed against each other and electrically connected to each other, the assembly forming a module called monolithic, in other words, a compact assembly, comprising connection terminals intended to be connected to corresponding connection terminals of the transfer substrate.

It would be desirable to be able to at least partly improve certain aspects of an image display device of this type.

SUMMARY

An embodiment provides an elementary module of a display device enabling to display at least one pixel of an image, the module comprising:

- a first assembly of N LEDs distributed into M groups, at least one of the M groups comprising at least two LEDs, where N and M are integers, with M greater than or equal to 2; and
- a control circuit comprising M bias circuits respectively associated with the M groups of LEDs, each bias circuit being shared by the LEDs of the corresponding group and being adapted to successively controlling the emission of the LEDs of the group.

According to an embodiment, the module forms a compact assembly of one or a plurality of electronic chips, the module comprising a connection surface comprising connection pads intended to be bonded and electrically connected to corresponding connection pads of a transfer substrate.

According to an embodiment, each of the M groups comprises a same number L of LEDs, L being an integer greater than or equal to 2.

According to an embodiment, the bias circuits are configured so that, in each group, for each LED in the group, an emission period of the LED is simultaneous with an emission period of a corresponding LED of each other group.

According to an embodiment, the control circuit is configured to, during a period T_TRAME, individually adjust the respective emission powers of the N LEDs.

According to an embodiment, period T_TRAME is divided into successive L periods Tj, with j an integer ranging from 1 to L, each period Tj comprising an initialization period T_INIT followed by an emission period T_E, the control circuit being configured to, at each period Tj, during initialization period T_INIT, successively apply to the M bias circuits a signal for individually adjusting the desired emission power of the LED of rank j of the corresponding group of LEDs G(i), and then, during the emission period, simultaneously control the emission of the M LEDs of rank j according to said individual adjustment signals.

According to an embodiment, the module comprises at least one terminal of connection to an external device, said terminal being intended to receive signals for individually adjusting the emission powers of the N LEDs of the chip, multiplexed in the time domain.

According to an embodiment, each bias circuit comprises a switch coupling said terminal to a light power adjustment node, and to an assembly of switches, respectively coupling the LEDs of the corresponding group to a node for delivering a bias current.

According to an embodiment, each bias circuit comprises a bias current source of adjustable intensity, the emission power of each of the LEDs in the corresponding group being adjusted by varying the current supplied by said current source.

According to an embodiment, each bias circuit comprises a fixed bias voltage source, the emission power of each of the LEDs in the corresponding group being adjusted by modulation of the emission time of the LED, for example, according to a binary code modulation.

According to an embodiment, each bias circuit comprises a bias current source with an adjustable intensity, the emission power of each of the LEDs in the corresponding group being adjusted by varying the current supplied by said current source and by modulation of the emission time of the LED, for example according to a binary code modulation.

According to an embodiment, the N LEDs of the first assembly are of a same first color, the module further comprising a second assembly of N LEDs of a same second color distributed into M groups, at least one of the M groups comprising at least two LEDs, and a third assembly of N LEDs of a same third color distributed into M groups, at least one of the M groups comprising at least two LEDs.

According to an embodiment, the first LED assembly forms a LED chip and the control circuit is a CMOS-type integrated circuit forming a control chip placed against a surface of the LED chip.

According to an embodiment, the module is configured to display a single pixel of same spatial coordinate for a set of N images of same dimensions, the N LEDs of the module corresponding to N sub-pixels of a same pixel, each sub-pixel enabling to display a pixel of one of the N images respectively corresponding to N viewing angles of a multi-view display device.

Another embodiment provides a display device comprising a transfer substrate and a plurality of modules such as defined hereabove arranged in an array on the transfer substrate, the modules being fixedly assembled to the transfer substrate and connected to electric connection elements of the transfer substrate, intended to convey signals for powering and controlling the modules.

BRIEF DESCRIPTION OF THE DRAWINGS

The foregoing features and advantages, as well as others, will be described in detail in the following description of specific embodiments given by way of illustration and not limitation with reference to the accompanying drawings, in which.

DETAILED DESCRIPTION OF THE PRESENT EMBODIMENTS

Like features have been designated by like references in the various figures. In particular, the structural and/or functional features that are common among the various embodiments may have the same references and may dispose identical structural, dimensional and material properties.

For the sake of clarity, only the steps and elements that are useful for an understanding of the embodiments described herein have been illustrated and described in detail. In particular, the manufacturing of the elementary modules of the described display devices has not been detailed, the manufacturing of such modules being within the abilities of those skilled in the art based on the teachings of the present disclosure. Each elementary module is intended to be fixedly assembled to a transfer substrate and connected to elements of electric connection of the transfer substrate for its control. Each elementary module comprises a monolithic chip or an assembly of a plurality of electrically-connected monolithic chips. Generally, an elementary module is a compact assembly of one or a plurality of electronic chips advantageously obtained according to microelectronic component manufacturing methods. A plurality of modules, for example, identical or similar, may be assembled on a same transfer substrate, each module for example corresponding to a pixel of the display device. As an example, the elementary modules of the described display devices each comprise a plurality of LEDs and a control circuits based on transistors, and may be manufactured according to methods identical or similar to those described in the above-mentioned patent application WO2017089676.

Unless indicated otherwise, when reference is made to two elements connected together, this signifies a direct connection without any intermediate elements other than conductors, and when reference is made to two elements coupled together, this signifies that these two elements can be connected or they can be coupled via one or more other elements.

Unless specified otherwise, the expressions "around", "approximately", "substantially" and "in the order of" signify within 10%, and preferably within 5%.

Figure 1:
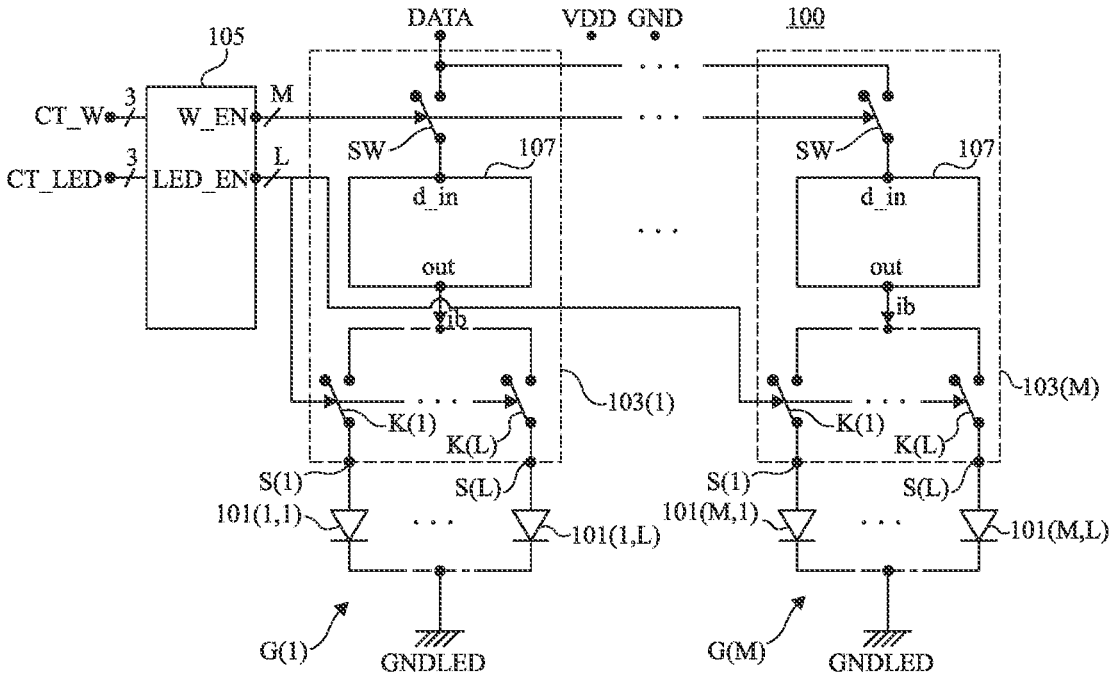
FIG. 1 is an electric diagram of circuits of an example of an elementary module of a display device according to an embodiment.

FIG. 1 is an electric diagram of the circuits of an example of a pixel 100 of a display device according to an embodiment. In this example, module 100 is a monolithic module formed by an assembly of a control chip and of a LED chip. The LED chip is for example arranged on top of and in contact with the control chip. As an example, the LED chip comprises, on its lower surface side, electric connection terminals electrically connected to electric connection terminals arranged on the upper surface side of the control chip.

The forming of a so-called multi-view display device, that is, where the image to be displayed is divided into pixels, each comprising a plurality of sub-pixels corresponding to different views of the scene which is desired to be shown, is more particularly considered. As an example, the different sub-pixels of a same pixel respectively correspond to a same pixel of different images of a same scene, taken under different viewing angles. A multi-view display device may for example be used in applications where it is desired to give the user an impression of three-dimensional viewing.

In the example of FIG. 1, the display device is a monochromatic device. Each module 100 comprises an assembly of N elementary LEDs 101 of same color, that is, having a same central emission wavelength, N being an integer, preferably greater than or equal to 4, forming the LED chip of the module. The N LEDs 101 are for example all identical, to within manufacturing dispersions. The N LEDs of the module are individually controllable and respectively correspond to N sub-pixels of a multi-view pixel. Each module further comprises, placed against and electrically connected to the LED chip, an integrated circuit for controlling the N LEDs, for example, a CMOS ("Complementary Metal Oxide Semiconductor") circuit, forming the module control chip.

A display device may comprise a plurality of elementary modules 100, identical or similar, arranged on a same transfer substrate, for example, in an array layout. The transfer substrate is for example a passive transfer substrate, comprising electric connection elements for the power supply and the control of the modules.

In the example of FIG. 1, the N LEDs 101 of module 100 are distributed into M groups G(1), . . . , G(M) of L LEDs each, M and L being integers greater than or equal to 2. Reference 101(*i*,*j*) designates hereafter the LED 101 of rank j of group G(i), i being an integer ranging from 1 to M and j an integer ranging from 1 to L.

In the example of FIG. 1, the circuit for controlling module 100 comprises M bias circuits 103(1), . . . , 103(M) respectively associated with the M groups of LEDs G(1), . . . , G(M). The circuit for controlling module 100 further comprises a circuit 105 for controlling the M bias circuits 103(*i*).

The M bias circuits 103(1), . . . , 103(M) are for example identical, to within manufacturing dispersions. Each bias circuit 103(*i*) comprises L output nodes S(1), . . . , S(L) coupled, preferably connected, respectively to the anodes of the L LEDs 101(*i*,1), . . . , 101(*i*,L) of the corresponding group G(i). In this example, in each group G(i) of LEDs, the cathodes of the LEDs are coupled, preferably connected, to a same node of application of a fixed reference potential GNDLED of the module, for example, the ground. As a variant (not shown), the orientations of the LEDs may be inverted. In other words, each LED 101(*i*,*j*) may have its cathode coupled, for example, connected, to the corresponding output node S(j) of bias circuit 103(*i*), and its anode coupled, for example, connected, to a terminal of application of a reference potential. Bias circuit 103 may then be a CMOS circuit complementary to that previously described.

In the example of FIG. 1, each bias circuit 103(*i*) comprises a bias current source 107 common to the L LEDs 101(*j*) of the corresponding group G(i). The source of bias current 107 comprises an input node d_in intended to receive a set point signal for adjusting the bias current delivered by source 107. Bias source 107 further comprises an output node out intended to supply a bias current ib according to the value of the set point signal applied to node d_in.

In this example each bias circuit 103(*i*) further comprises L individually-controllable switches K(1), . . . , K(L) respectively coupling the L output nodes S(1), . . . , S(L) of the circuit 103(*i*) to the output node out of the bias current source 107 of circuit 103(*i*). Each switch K(j) has a first conduction node coupled, for example connected, to the node out of the bias current source 107 of circuit 103(*i*), and a second conduction node coupled, for example, connected, to the output node S(j) of same rank j of circuit 103(*i*).

In the example of FIG. 1, each bias circuit 103(*i*) further comprises a switch SW. Switch SW couples the control node d_in of current source 107 to a terminal DATA of application of a signal for controlling module 100. More particularly, switch SW has a first conduction node coupled, for example, connected, to terminal DATA, and a second conduction node coupled, for example, connected, to node d_in. Input terminal DATA is common to all the LEDs of module 100. The individual luminosity adjustment signals of the M*L LEDs 101 are time-multiplexed on terminal DATA. The M switches SW and the M*L switches K(j) of the module enable to demultiplex the luminosity adjustment signals to individually control the M*L LEDs 101.

Control circuit 105 enables to control the M switches SW and the M*L switches K(j). More particularly, in this example, control circuit 105 generates a control signal W_EN over M bits to respectively control the M switches SW. In this example, signal W_EN is delivered on a parallel port of M output nodes of circuit 105, respectively connected to the control nodes of the M switches SW. Control circuit 105 further generates a control signal LED_EN over L bits to respectively control the L switches K(j) of each bias circuit 103(*i*). In this example, the same control signal LED_EN is applied in parallel with the M bias circuits 103(*i*). Signal LED_EN is supplied on a parallel port of L output nodes of circuit 105, respectively connected to the control nodes of the L switches K(j) of each of the M bias circuits 103(*i*). Thus, each bit LED_EN<j> of signal LED_EN is simultaneously applied to the control nodes of the M switches K(j) of same rank j of the control circuit. In other words, for each rank j in the range from 1 to L, the M switches K(j) of same rank j are all simultaneously controlled to the same state. Thus, for each rank j in the range from 1 to L, the M LEDs 101(*i,j*) of same rank are all simultaneously activated in emission mode or are all simultaneously deactivated.

Figure 2:
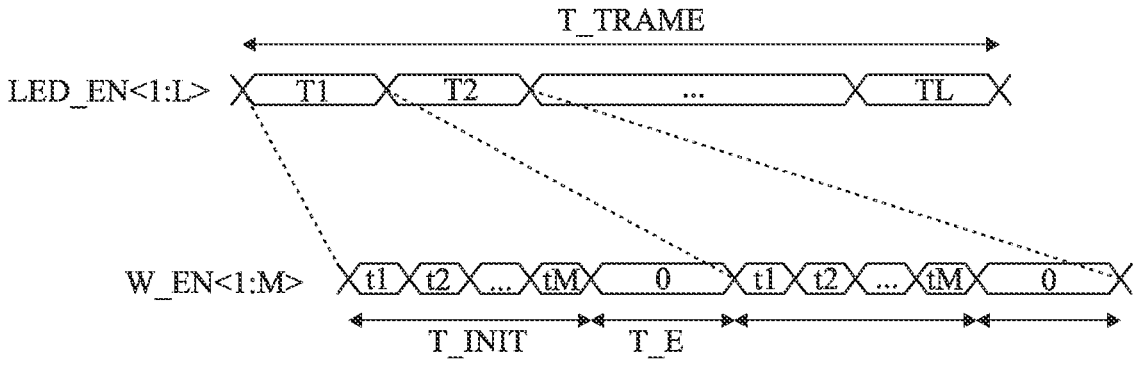
FIG. 2 is a timing diagram illustrating an example of operation of the elementary module of FIG. 1.

FIG. 2 is a timing diagram illustrating an example of operation of the module 100 of FIG. 1.

FIG. 2 schematically shows the time variation of the control signals W_EN (M bits) and LED_EN (L bits) supplied by control circuit 105.

A period T_TRAME corresponding to the time available to individually control the M*L LEDs 101 of module 100 according to, respectively, M*L specific luminosity levels is defined hereafter. At each new period T_TRAME, the luminosity levels of the M*L LEDs 101 may be modified.

Period T_TRAME is divided into L successive periods T1, T2, . . . TL for example, substantially of same duration, for example, substantially equal to T_TRAME/L.

During each period Tj, the M LEDs 101(1,j), . . . 101(M,j) of same rank j of the module are simultaneously controlled in emission mode. The other LEDs 101 are deactivated.

More particularly, in this example, each period Tj is divided into two successive periods, T_INIT and T_E. Period T_INIT is an initialization period and period T_E is an emission period.

During period T_INIT, the signals for adjusting the M LEDs 101(1,j), . . . , 101(M,j), sequentially received on the data input DATA of the module, are successively applied on the input terminals d_in of the respective bias current sources 107 of the M bias circuits 103(*i*). More particularly, in this example, period T_INIT is divided into M successive periods t1, . . . , tM, for example substantially of same duration, for example, substantially equal to T_INIT/M. At each period ti, with i ranging from 1 to M, the switch SW of bias circuit 103(*i*) is controlled to the on state, the other switches SW being maintained off. The adjustment signal applied to terminal DATA is thus transmitted to the input terminal d_in of the bias source 107 of bias circuit 103(*i*). Thus, the bias current sources 107 of the M bias circuits 103(*i*) are successively adjusted to current values corresponding to the respective desired luminosity levels of LEDS 101(1,j), . . . , 101(M,j).

During emission period T_E, the switches K(j) of the M bias circuits 103(*i*) are simultaneously turned on, while the other switches K are all maintained off. Thus, LEDs 101(1, j), . . . , 101(M,j) simultaneously emit at luminosity levels individually adjusted during period T_INIT. The other LEDs 101 remain inactive. During emission period T_E, the M switches SW may all be simultaneously controlled to the off state.

At the end of emission period T_E, a new period Tj+1 starts, during which LEDs 101(1,j+1), . . . , 101(M,j+1) are individually adjusted and then simultaneously controlled in emission mode.

One thus carries out, in parallel in the M groups of LEDs G(i), a sequential scanning of the L LEDs 101 of each group G(i).

An advantage of the architecture of FIG. 1 and of the operation described in relation with FIG. 2 is linked to the provision of bias circuits 103(*i*) shared by groups of L LEDs 101. This enables to limit the general bulk of the LED control circuit. In particular, the size of control circuit 105 is relatively limited. As an example, control circuit 105 may comprise two shift registers, not detailed in the drawing, of respectively L bits and M bits, to respectively generate signals LED_EN and W_EN.

The number of connection terminals outside of module 100 is further relatively low due to the time multiplexing of the data signal on a single terminal DATA. As an example, in addition to terminal DATA, module 100 may comprise a terminal VDD of connection to a high power supply potential and a terminal GND of connection to a low power supply potential. Each bias current source 107 may have a power supply node coupled, for example, connected, to terminal VDD (connections not detailed in FIG. 1). Terminal GND may be coupled, for example connected, to node GNDLED (connection not detailed in FIG. 1). Module 100 may further comprise one or a plurality of terminals of application of control signals. As an example, module 100 may comprise a port CT_W formed of three terminals (not detailed in FIG.

1) of application of signals for controlling the shift register generating signal W_EN, and a portion CT_LED formed of three terminals (not detailed in FIG. 1) of application of signals for controlling the shift register generating signal LED_EN. Port CT_W for example comprises a first terminal of application of a clock signal of the shift register generating signal W_EN, a second terminal of application of a signal for resetting the shift register generating signal W_EN, and a third terminal of application of a signal for initializing the shift register generating signal W_EN. Port CT_LED for example comprises a first terminal of application of a clock signal of the shift register generating signal LED_EN, a second terminal of application of a signal for resetting the shift register signal LED_EN, and a third terminal of application of a signal for initializing the shift register generating signal LED_EN. Thus, in this example, module 100 comprises, in addition to the inner electric connections between the LED chip and the control chip, 9 electric connection terminals, intended to be respectively connected to corresponding connection terminals of the transfer substrate.

Figure 3:
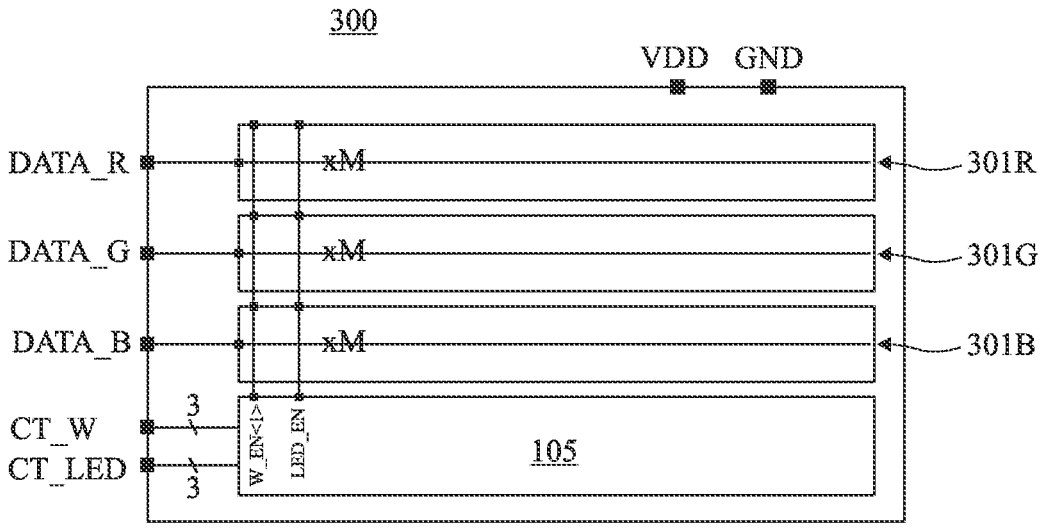
FIG. 3 is a simplified representation of another example of an elementary module of a display device according to an embodiment.

FIG. 3 is a simplified representation of another example of a module 300 of a display device according to an embodiment.

The module 300 of FIG. 3 differs from the module 100 of FIG. 1 mainly in that, in module 300, the LED chip comprises LEDs of a plurality of colors, that is, having distinct central emission wavelengths. In the example of FIG. 3, the LED chip of module 300 comprises LEDs of three distinct colors, for example, first ones adapted to mainly emitting red light, second ones adapted to mainly emitting green light, and third LEDs adapted to mainly emitting blue light. As in the example of FIG. 1, module 300 comprises, placed against and electrically connected to the LED chip, a control chip adapted to individually controlling the LEDs of the LED chip.

In the example of FIG. 3, the assembly comprising the M*L elementary LEDs 101, the M bias circuits 103(*i*), and the data input terminal DATA of the module of FIG. 1 is replicated three times (once per color), with respectively three types of elementary LEDs of different colors. The M bias circuits 103(*i*) may possibly be adapted to supplying different mean currents according to whether they are connected to red, blue, or green LEDs, but their structure remains unchanged.

In FIG. 3, the data input terminals corresponding to the three emission colors are respectively designated with references DATA_R, DATA_G, and DATA_B. Further, reference 301R designates the assembly of the M*L red LEDs 101 and of the corresponding bias circuits 103(*i*), reference 301G designates the assembly of the M*L green LEDs 101 and of the corresponding bias circuits 103(*i*), and reference 301B designates the assembly of the M*L blue LEDs 101 and of the corresponding bias circuits 103(*i*).

In the example of FIG. 3, control circuit 105 is shared by the three colors. This circuit and its operation are for example identical or similar to what has been described in relation with FIGS. 1 and 2.

Thus, referring to FIG. 2, during each period Tj of period T_TRAME, the M LEDs 101 of same rank j of assembly 301R, the M LEDs 101 of same rank j of assembly 301G, and the M LEDs 101 of same rank j of assembly 301B are simultaneously controlled in emission mode, the other LEDs 101 being deactivated.

More particularly, during the initialization period T_INIT of phase Tj, the signals for adjusting the M LEDs 101(1,j), . . . , 101(M,j) of assembly 301R, sequentially received on the data input terminal DATA_R of the module, are successively applied to the input terminals d_in of the respective bias current sources 107 of the M bias circuits 103(*i*) of assembly 301R, identically or similarly to what has been described hereabove. In parallel and similarly, the signals for adjusting the M LEDs 101(1,j), . . . , 101(M,j) of assembly 301G, sequentially received on the input terminals DATA_G of the module, are successively applied to the input terminals d_in of the respective bias current sources 107 of the M bias circuits 103(*i*) of assembly 301G, and the signals for adjusting the M LEDs 101(1,j), . . . , 101(M,j) of assembly 301B, sequentially received on the input terminal DATA_B of the module, are successively applied to the input terminals d_in of the respective bias current sources 107 of the M bias circuits 103(*i*) of assembly 301B.

More particularly, at each period ti of period T_INIT of phase Tj, with i ranging from 1 to M, in each of assemblies 301R, 301G, and 301B, the switch SW of bias circuit 103(*i*) is controlled to the on state, the other switches SW being maintained off. The adjustment signal applied to terminal DATA_R, respectively DATA_G, respectively DATA_B, is thus transmitted to the input terminal d_in of the bias source 107 of bias circuit 103(*i*) of assembly 301R, respectively 301G, respectively 301B. Thus, in each of assemblies 301R, 301G, and 301B, the bias current sources 107 of the M bias circuits 103(*i*) are successively adjusted to current values corresponding to the respective desired luminosity levels of LEDS 101(1,j), . . . , 101(M,j) of the assembly.

During emission period T_E, in each of assemblies 301R, 301G, and 301B, the switches K(j) of the M bias circuits 103(*i*) are simultaneously turned on, while the other switches K are all maintained off. Thus, the LEDs 101(1,j), . . . , 101(M,j) of the assembly simultaneously emit at luminosity levels individually adjusted during period T_INIT. The other LEDs 101 remain inactive. During emission period T_E, the M switches SW may all be simultaneously turned off.

In the example of FIG. 3, module 300 comprises, in addition to the inner electric connections between the LED chip and the control chip, 11 electric connection terminals, intended to be respectively connected to corresponding connection terminals of the transfer substrate.

Figure 4:
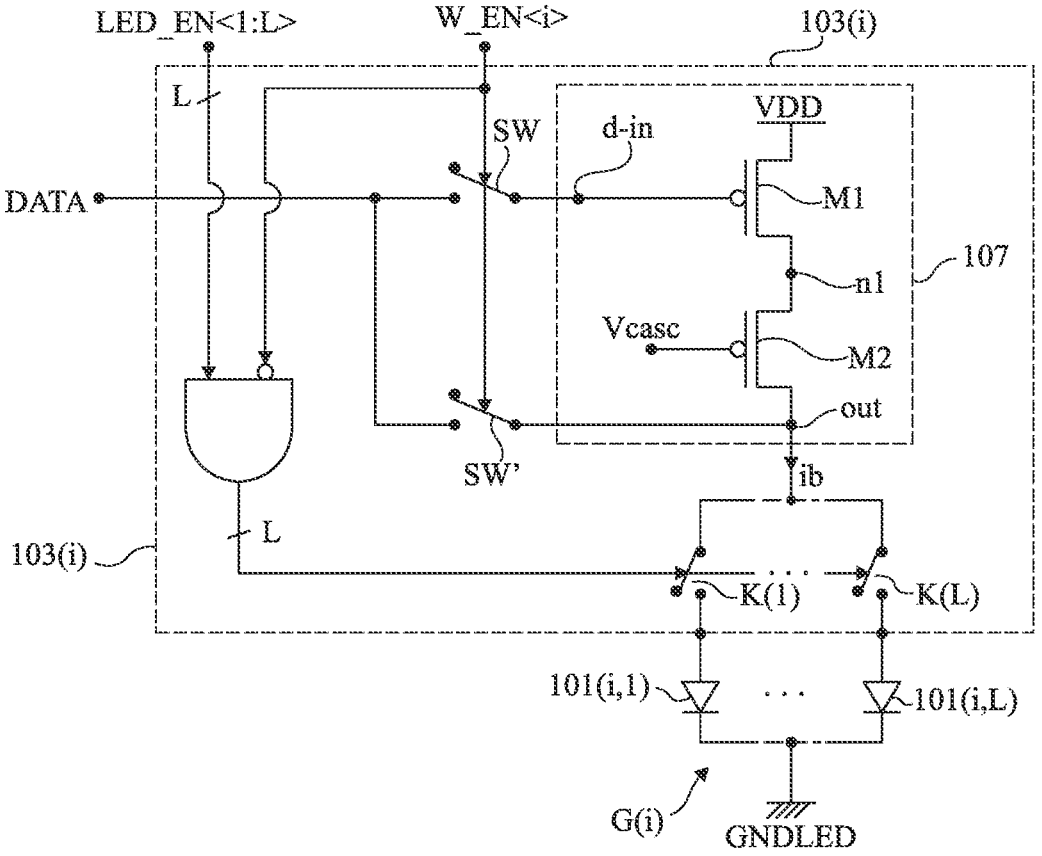
FIG. 4 illustrates in further detail an example of a circuit for controlling an elementary module according to an embodiment.

FIG. 4 illustrates in further detail an example of a circuit for controlling a module according to an embodiment. FIG. 4 more particularly illustrates an example of embodiment of a bias circuit 103(*i*) of the module 100 of FIG. 1.

In this example, bias circuit 103(*i*) comprises two transistors M1 and M2 forming a cascoded current source. In the shown example, transistors M1 and M2 are P-channel MOS transistors. Transistor M1 has its source coupled, for example, connected, to node VDD and its drain coupled, for example, connected, to an intermediate node n1. Transistor M2 has its source coupled, for example connected, to node n1 and its drain coupled, for example connected, to node out. The gate of transistor M1 is coupled, for example connected, to node d_in. The gate of transistor M2 is coupled, for example connected, to a node of application of a fixed voltage Vcasc. In this example, each bias circuit 103(*i*) further comprises a switch SW' coupling the output node out of current source 107 to terminal DATA. Switch SW' has a first conduction node coupled, for example connected, to terminal DATA, and a second conduction node coupled, for example, connected, to node out. Switch SW' has a control node coupled, for example, connected, to node W_EN<i>. In each bias circuit 103(*i*), the switches SW and SW' of the bias circuit are for example simultaneously controlled to the same state. When switches SW and SW' are in the on state, the drain of transistor M2 is coupled, for example, connected, to the gate of transistor M1. The potential difference applied between nodes d_in and VDD defines the intensity of the bias current ib delivered by current source 107 on its output node out, and thus the light intensity of emission of the LED 101(*i*,*j*) having current ib applied thereto. The gate-source capacitance of transistor M1 (not detailed in the drawing) enables to maintain the voltage between nodes d_in and VDD substantially constant all along the LED emission time.

As a variant, the cascode assembly may be replaced with a simple transistor. In this case, transistor M2 is omitted, the drain of transistor M1 being then directly coupled, for example connected, to node out. More generally, it will be within the abilities of those skilled in the art to provide other implementations of current source 107. In another variant, a voltage control may be provided. In this case, transistor M2 may be omitted and transistor M1 may be replaced with an N-channel MOS transistor acting as a voltage follower.

In the example of FIG. 4, control signal W_EN<i> directly controls the switch SW coupling the input node d_in of current source 107 to terminal DATA and the switch SW' coupling the output node out of current source 107 to terminal DATA. Further, in this example, switches K(1), . . . , K(L) are controlled, not directly by signal LED_EN<1:L>, but by a combination of signal LED_EN<1:L> and of the complemented signal W_EN(i). In other words, each switch K(j) is controlled to the on state only when signal LED_EN<j> is in the high state and signal W_EN<i> is in the low state (switch SW of circuit 103(*i*) off).

In the above-described examples, neglecting the time of initialization of the LED biasing circuits, the emission time T_E of each LED is substantially equal to T_TRAME/L. Thus, as compared with a non-multiplexed display device, that is, where all LEDs emit simultaneously for the entire period T_TRAME, the intensity of bias current ib has to be multiplied by L to obtain an equivalent luminosity level. This is an advantage since LEDs generally have a better external quantum efficiency (EQE) for high bias currents. The number M of bias circuits 103(*i*) and accordingly the number L of elementary LEDs addressed by each bias circuit 103(*i*) may be selected to maximize the external quantum efficiency.

Figure 5:
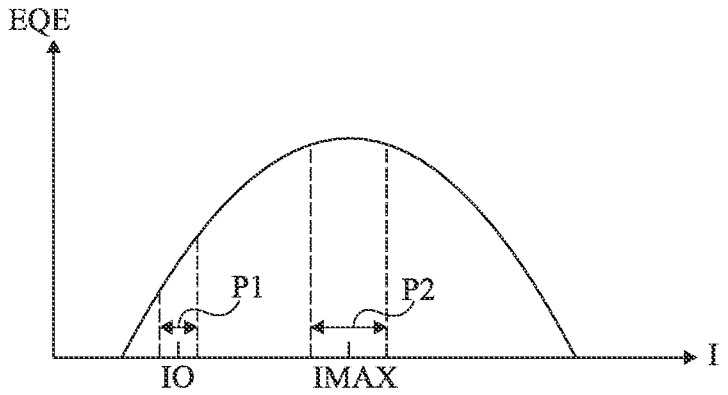
FIG. 5 shows an example of a curve characteristic of the quantum efficiency of a LED.

FIG. 5 is a diagram schematically showing the variation of the external quantum efficiency EQE (in ordinates) of a LED according to the density I (in abscissas) of the bias current applied to the LED.

As shown in the drawing, the external quantum efficiency is bell-shaped with a maximum for a current value IMAX. Call I0 the average intensity of range P1 where the LEDs would be desired to be biased in the case of a continuous emission all along duration T_TRAME (that is, in a non-multiplexed device). In this example, value I0 is smaller than value IMAX.

Considering the example of FIG. 1, if ratio IMAX/I0 is smaller than N−1, N being the number of sub-pixels, corresponding to the number of different views, of the multi-view pixel, L will preferably be selected to be equal to E[MAX/I0]+1, where E[IMAX/I0] designates the integer part of IMAX/I0, and M equal to E[(N−1)/L]+1. There then will be an emission time per LED substantially equal to T_TRAME/L and accordingly an average bias current ILED of each LED substantially equal to I0*L, that is, substantially equal to I0*(E[IMAX/I0]+1). Thus, current ILED approaches current IMAX from a higher value. This enables to maximize the external quantum efficiency of the LEDs.

Figure 6:
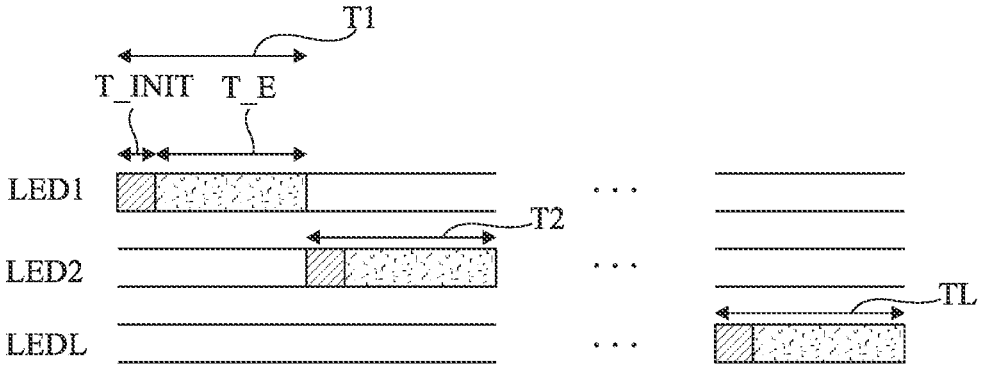
FIG. 6 illustrates an example of operation of an elementary module according to an embodiment.

This configuration is schematically illustrated by FIG. 6 (considering the durations of initialization phases T_INIT as negligible).

If ratio IMAX/I0 is greater than N−1, it is preferable for the emission time of each LED to be shorter than T_TRAME/L to have an average bias current I0 approaching current IMAX. Each period Tj of period T_TRAME may then comprise a period during which the LED is off. In other words, each LED emits for a portion only of the period T_E assigned for the emission.

Figure 7:
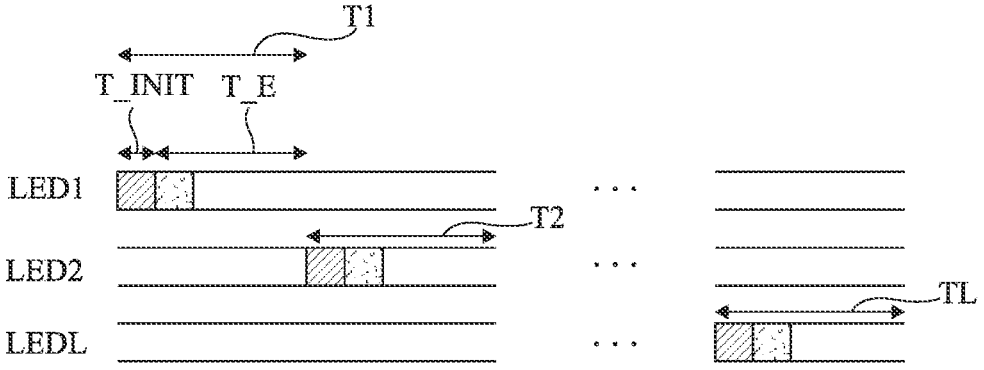
FIG. 7 illustrates another example of operation of an elementary module according to an embodiment.

This configuration is schematically illustrated by FIG. 7 (here again considering the durations of initialization phases T_INIT as negligible).

FIG. 5 schematically shows a range P2 centered on current IMAX, corresponding to the transposition of range P1 around value IMAX due to the decrease in the effective emission time of each LED.

Figure 8:
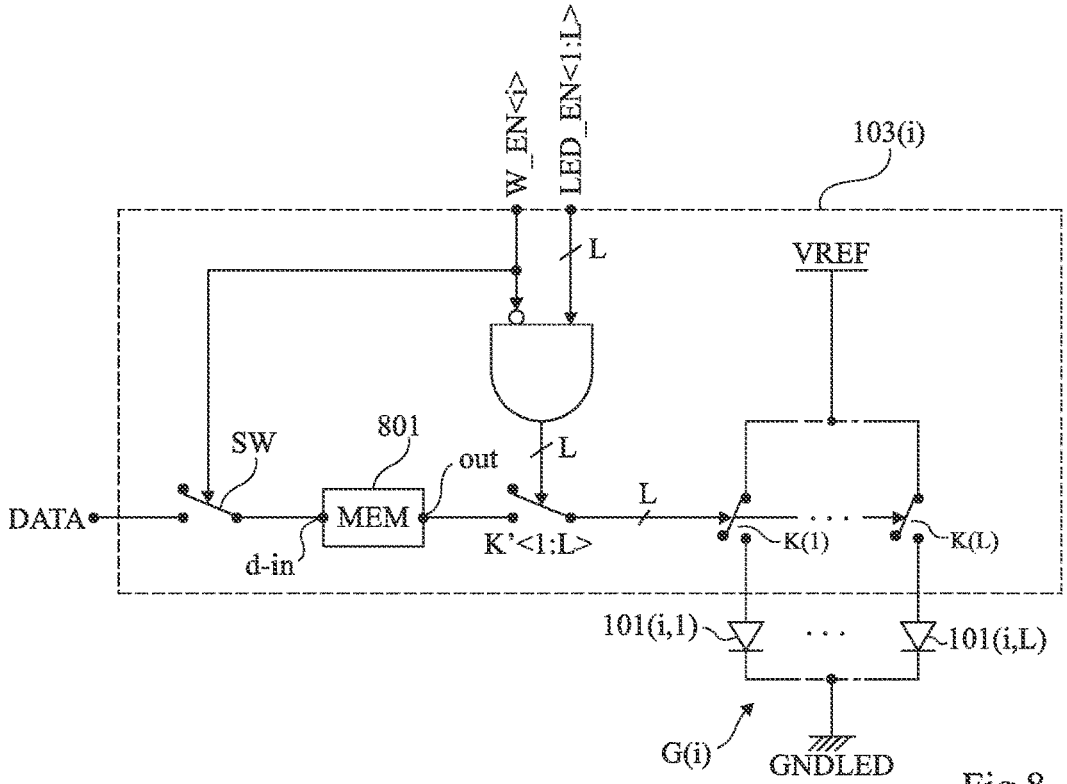
FIG. 8 illustrates in further detail another example of a circuit for controlling an elementary module according to an embodiment.

FIG. 8 illustrates in further detail another example of a circuit for controlling a module according to an embodiment. FIG. 8 more particularly illustrates an alternative embodiment of a bias circuit 103(*i*) of the module 100 of FIG. 1. In the following description, only the differences with respect to the bias circuit 103(*i*) of FIG. 1 will be highlighted.

In this example, circuit 103(*i*) is a time biasing circuit. In other words, the bias voltage applied to the LEDs has a fixed value. The individual luminosity levels of the LEDs are controlled by modulation of the emission time of each LED. With a sufficiently high refreshment level, for example greater than or equal to 50 frames per second, the persistence of vision enables to average the luminance seen from each LED during each period T_TRAME. As an example, the modulation of the emission times of each LED is a binary code modulation, for example, a BCM-type modulation. Calling L_PERCUE the seen luminance, L0 the fixed luminance defined by the fixed bias voltage VREF applied to the LEDs, n the number of bits having the luminosity information coded thereon, and bk the bit of weight k of the coding, k being an integer ranging from 1 to n, one has:

[Math 1]

$$L_{PERCUE} = \sum_{k=1}^{n} bk \frac{L0}{M * 2^{n+1-k}}.$$

In the example of FIG. 8, current source 107 is omitted, and switches K(1), . . . K(L) directly couple the respective anodes of LEDs 101(*i*,1), . . . , 101(*i*,L) at a same node of application of a fixed bias potential VREF.

In this example, the luminosity information is stored in binary form in a memory circuit or a register 801 (MEM) of circuit 103(*i*), during period ti of the phase T_INIT of each period Tj of period T_TRAME.

Switch SW couples terminal DATA to an input node d_in of memory circuit 801. During the emission phase T_E of each LED 101(*i*,*j*) of group G(i), the corresponding switch K(j) (that is, of same rank j) is alternately controlled to the on state and to the off state according to a modulation pattern set by the digital n-bit code stored in memory circuit 801. The other switches K(j) are maintained off.

In the example of FIG. 8, bias circuit 103(*i*) comprises L switches K'<1>, . . . , K'<L>. Each switch K'<j> has a first conduction node coupled, for example connected, to an output node out of memory circuit 801, and a second conduction node coupled, for example, connected, to a control node of the switch K(j) of same rank j. During the emission phase T_E of each LED 101(*i,j*), the corresponding switch K'(j) is maintained on, the other switches K' of the circuit 103(*i*) being maintained off. Thus, the n bits of the luminosity code are successively applied to the control node of switch K(j), which enables to control the average light power emitted by LED 101(*i,j*).

In the example of FIG. 8, control signal W_EN<i> directly controls the switch SW coupling terminal DATA to the input node d_in of memory circuit 801. Further, in this example, switches K'(1), . . . , K'(L) are controlled not directly by signal LED_EN<1:L> but by a combination of signal LED_EN<1:L> and of the complemented signal W_EN(i). In other words, each switch K'(j) is controlled to the on state only when signal LED_EN<j> is in the high state and signal W_EN<i> is in the low state (switch SW of circuit 103(*i*) off).

More generally, it will be within the abilities of those skilled in the art to adapt the described embodiments to other types of bias circuits with a time modulation of the LED emission time, for example, circuits of the type described in patent application FR3076396A1.

Figure 9:
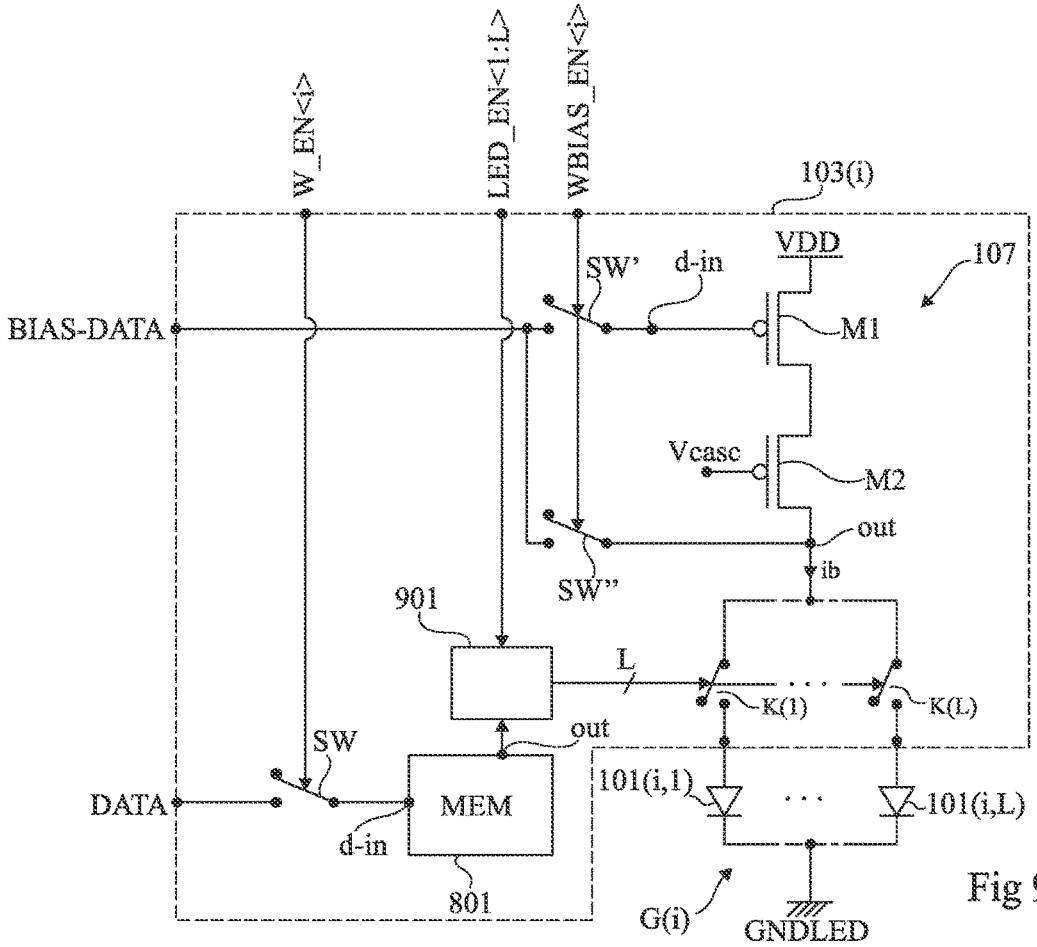
FIG. 9 illustrates in further detail another example of a circuit for controlling an elementary module according to an embodiment.

FIG. 9 illustrates in further detail another example of a circuit for controlling a module according to an embodiment. FIG. 9 more particularly illustrates an alternative embodiment of a bias circuit 103(*i*) of the module 100 of FIG. 1. In the following description, only the differences with respect to the bias circuit 103(*i*) of FIG. 1 will be highlighted.

In this example, circuit 103(*i*) combines a luminosity control by adjustment of the intensity of the LED bias current, such as described in relation with FIGS. 1 and 4, and by time modulation, such as described in relation with FIG. 8.

More particularly, in the example of FIG. 9, circuit 103(*i*) comprises the same elements as in the example of FIG. 8, arranged substantially in the same way, and further comprises an adjustable current source 107 identical or similar to what has been described in relation with FIGS. 1 and 4. The output node out of the current source is coupled, for example, connected, to the ends of switches K(1), . . . K(L) opposite to LEDs 101. Circuit 103(*i*) further comprises a switch SW' coupling the input node d_in of current source 107 to an additional data input terminal BIAS_DATA of the module, and a switch SW" coupling the output node out of current source 107 to terminal BIAS_DATA.

The switches SW' and SW" of the M circuits 103(*i*) are controlled by a signal WBIAS_EN over M bits, for example, identical to signal W_EN. In each circuit 103(*i*), switches SW' and SW" are for example simultaneously controlled to the same state by signal WBIAS_EN<i>.

In FIG. 9, there has further been shown a logic circuit 901, particularly integrating the switches K'<j> of FIG. 8. Logic circuit 901 receives control signal LED_EN (over L bits) and the binary modulation codes supplied on the output node out of memory circuit 801, and generates the signals for controlling switches K(j). Logic circuit 901 particularly enables to select the emitting LED, similarly to what has been described in relation with FIG. 8.

The current biasing enables to individually adjust, for each LED, an average luminance point L0, for example, identical for all LEDs. This enables for example to compensate for possible manufacturing dispersions between LEDs. As an example, the adjustment value applied to terminal BIAS_DATA is coded over 5 bits, which provides 32 possible intensity values of bias current ib. The time modulation controlled via terminal DATA enables to adjust the grey levels desired for each elementary LED of the module.

Various embodiments and variants have been described. Those skilled in the art will understand that certain features of these various embodiments and variants may be combined, and other variants will occur to those skilled in the art. In particular, the described embodiments are not limited to the above-mentioned application to multi-view display devices, but may be applied to any display device comprising elementary modules, each comprising a plurality of LEDs.

Further, the described embodiments are not limited to the specific case described hereabove where each assembly of N LEDs distributed into M groups G(i) only comprises LEDs of same color. As a variant, each assembly of N LEDs and/or each group G(i) may comprise LEDs of different colors.

Further, the described embodiments are not limited to the preferred examples described hereabove where an assembly of N LEDs is divided into M groups, each comprising a same number L of LEDs. As a variant, different groups may contain different numbers of LEDs, at least one group comprising at least two LEDs. One bias circuit 103(*i*) per group of LEDs (that is, M bias circuits) is then provided, similarly to what has been described hereabove. The bias circuits 103(*i*) and their operation are identical or similar to what has been previously described, to within the difference that, in groups comprising fewer LEDs, the missing LEDs are not addressed. In particular, the number of switches K(j) or K'(j) may be different in the different bias circuits 103(*i*).

Further, an example of a color module where the number of LEDs of each color is identical has been described hereabove in relation with FIG. 3. As a variant, the number of LEDs may vary from one color to another. It will be within the abilities of those skilled in the art to adapt control circuit 105 accordingly. In the example of FIG. 3, it may further be provided to duplicate one of the LED assemblies, for example, in order to have a more homogeneous biasing in the case where one of the colors would have a different efficiency than the others.

It should be noted that in the present disclosure, pixel means a pixel of the image which is desired to be displayed. In the case where an elementary module integrates a plurality of sub-pixels, for example, N sub-pixels, each sub-pixel corresponds to a pixel of one of the N images which are desired to be rendered (with N different viewing angles). If an image is formed of an array of X*Y pixels, then the i-th sub-pixel associated with a given pixel corresponds to a pixel of same coordinates (x,y) in the i-th image.

As a variant, an elementary module in the sense of the present application may integrate a plurality of pixels of a same image to be displayed. In the case of elementary modules, each comprising a single pixel, the modules may be spaced apart from one another on the transfer substrate. The surface area of the control chip of each module may then be greater than the surface area of the LED chip of the module. This enables to save on the surface area of the LED material with respect to the silicon surface area of the control chip. In the case of elementary modules, each comprising a plurality of pixels, it may be provided to place a plurality of elementary modules laterally against one another to form a display screen of greater dimensions. The control chip of each module will then preferably have substantially the same lateral dimensions as the LED chip of the module. As a variant, the control chip of each module may have a surface area smaller than the surface area of the LED chip, even if this variant is unlikely since the surface area of the control chip is generally constrained, particularly when the control chip comprises a single semiconductor layer and not a "3D" circuit.

Further, in the present disclosure, the term "chip" has been used to designate the presence in each module of a control chip and of a LED chip. In practice, each chip comprises semiconductor components formed inside and/or on top of a layer of a semiconductor material. Thus, the control chip comprises, among others, transistors, for example, of MOS type, comprising, as well know, portions formed in a semiconductor layer (for example silicon) and portions (for example, metallic, insulating) formed above the semiconductor layer, and covered with dielectric materials having metal lines of connection between components formed therein. Similarly, the LED chip comprises light-emitting diodes formed at least partly in one or a plurality of stacked semiconductor layers. The LED chip may further comprise an assembly of other layers to form colored filters for example, or light conversion elements.

The control and LED chips may be manufactured separately and then bonded to each other. Alternately, one of the chips may be constructed directly on the other chip according to a sequential manufacturing method.

It should further be noted that a chip, particularly the control chip, may in practice be formed of a plurality of "tiers" or in other words of a plurality of chips stacked to form a "3D" circuit. The word "tier" is often used to designate the different stages, each comprising a semiconductor layer with components (transistors, resistors, . . . ), also called "front-end", and an alternation of dielectric and conductive layers to form an electric interconnection network, also called "back-end".

Finally, the practical implementation of the described embodiments and variations is within the abilities of those skilled in the art based on the functional indications given hereabove. In particular, the forming of the elementary LEDs and of the circuits for controlling the modules is within the abilities of those skilled in the art based on the functional indications of the present disclosure.

What is claimed is:

1. Display device comprising a transfer substrate and a plurality of elementary modules arranged in an array on the transfer substrate, each module forming a compact assembly of one or a plurality of electronic chips, each module comprising a connection surface comprising connection pads bonded and electrically connected to corresponding connection pads of the transfer substrate, intended to convey signals for powering and controlling the module, each module enabling to display at least one pixel of an image, each module comprising:

a first assembly of N LEDs distributed into M groups, at least one of the M groups comprising at least two LEDs, where N and M are integers, with M greater than or equal to 2; and a control circuit comprising M bias circuits respectively associated with the M groups of LEDs, each bias circuit being shared by the LEDs of the corresponding group and being adapted to successively controlling the emission of the LEDs of the group, wherein each module comprises at least one connection pad, called data pad, intended to receive individual signals for adjusting the emission powers of the N LEDs of the module, multiplexed in the time domain, and wherein in each module, each bias circuit of the module comprises a first selection switch coupling said data pad of the module to a light power adjustment node of the bias circuit, and comprises an assembly of second selection switches respectively coupling the LEDs of the group corresponding to a same node for supplying a bias current of the bias circuit, said bias current received by a selected LED being a function of an adjustment signal transmitted on said light power adjustment node.

2. Display device according to claim 1, wherein, in each module, the control circuit is configured to, during a period T_TRAME, individually adjust the respective emission powers of the N LEDs, period T_TRAME being divided into L successive periods Tj, with L an integer and j an integer ranging from 1 to L, each period Tj comprising an initialization period T_INIT followed by an emission period T_E, the control circuit being configured to, at each period Tj, during initialization period T_INIT, successively apply to the M bias circuits a signal for individually adjusting the desired emission power of the LED of rank j of the corresponding group of LEDs, and then, during the emission period T_E, simultaneously control the emission of the M LEDs of rank j according to said individual adjustment signals.

3. Device according to claim 2, wherein, during each initialization period T_INIT, the first selection switches of the bias circuits are successively turned on to transmit a signal received on said data pad to a light power adjustment node of the group selected by said turned on first selection switches, the second selection switches then being off, and wherein, in each bias circuit, during each emission period T_E, a single switch from among the second selection switches is turned on to select a single LED per group and apply thereto a bias current which is a function of the adjustment signal transmitted on said light power adjustment node of the associated bias circuit.

4. Display device according to claim 1, wherein, in each module (100; 300), the N LEDs of the first assembly are of a same first color, the module further comprising a second assembly of N LEDs (101(*i*,*j*)) of a same second color distributed into M groups (G(i)), at least one of the M groups comprising at least two LEDs, and a third assembly of N LEDs (101(*i*,*j*)) of a same third color distributed into M groups (G(i)), at least one of the M groups comprising at least two LEDs.

5. Device according to claim 4, wherein each module (100; 300) further comprises at least another connection pad, called control pad, allowing the reception of control signals used to generate internal signals for controlling the first and second selection switches, wherein the same internal controls signals are used to control the switches of the first, second, and third LED assemblies, and wherein first, second, and third data pads are respectively coupled to the first, second, and third LED assemblies to transfer in parallel light intensity adjustment signals to each of the three LED assemblies.

6. Display device according to claim 1, wherein, in each module (100; 300), each of the M groups (G(i)) comprises a same number of LEDs.

7. Display device according to claim 1, wherein, in each module (100; 300), the bias circuits (103(*i*)) are configured so that, in each group (G(i)), for each LED (101(*i*,*j*)) in the group, an emission period (T_E) of the LED is simultaneous with a period of emission (T_E) of a corresponding LED (101(*i*,*j*)) of each other group.

8. Display device according to claim 1, wherein, in each module (100; 300), each bias circuit (103(*i*)) comprises a bias current source (107) having an adjustable intensity, the emission power of each of the LEDs (101(*i*,*j*)) in the corresponding group being adjusted by varying the current supplied by said current source (107).

9. Display device according to claim 1, wherein, in each module (100; 300), each bias circuit (103(*i*)) comprises a fixed bias voltage source, the emission power of each of the LEDs (101(*i*,*j*)) in the corresponding group being adjusted by modulation of the emission time of the LED, for example, according to a binary code modulation.

10. Display device according to claim 1, wherein, in each module (100; 300), each bias circuit (103(*i*)) comprises a bias current source having an adjustable intensity, the emission power of each of the LEDs (101(I,j)) in the corresponding group being adjusted by varying the current supplied by said current source (107) and by modulation of the emission time of the LED, for example, according to a binary code modulation.

11. Display device according to claim 1, wherein, in each module (100; 300), the first LED assembly forms a LED chip and the control circuit is a CMOS-type integrated circuit forming a control chip placed against a surface of the LED chip.

12. Display device according to claim 1, wherein each module (100; 300) is configured to display a single pixel of same spatial coordinate for a set of N images of same dimensions, the N LEDs of the module corresponding to N sub-pixels of a same pixel, each sub-pixel enabling to display a pixel of one of the N images respectively corresponding to N viewing angles of a multi-view display device.

13. Display device according to claim 1, wherein each module (100; 300) further comprises at least another connection pad, called control pad, allowing the reception of control signals used to generate internal signals for controlling the first and second selection switches.

* * * * *